United States Patent [19]

Kinsey

[11] Patent Number: 4,472,851

[45] Date of Patent: Sep. 25, 1984

[54] GOLF CLUB CLEANER

[75] Inventor: Clifford J. Kinsey, Burlington, Wis.

[73] Assignee: K & D Marketing Corp., Burlington, Wis.

[21] Appl. No.: 474,364

[22] Filed: Mar. 11, 1983

[51] Int. Cl.[3] ..... A63B 57/00; A46B 13/06

[52] U.S. Cl. ..... 15/21 D; 15/75

[58] Field of Search ..... 15/21 C, 21 D, 24, 38, 15/39, 53 A, 53 AB, 56, 75, 76

[56] References Cited

U.S. PATENT DOCUMENTS

| | | | |
|---|---|---|---|
| 1,491,002 | 4/1924 | Dahlstrand | 15/24 |
| 3,148,396 | 9/1964 | Smith | 15/21 |
| 3,619,841 | 11/1971 | Russell et al. | 15/21 D |
| 3,872,534 | 3/1975 | Hoag | 15/21 D |

*Primary Examiner*—Edward L. Roberts

*Attorney, Agent, or Firm*—Wheeler Law Firm

[57] ABSTRACT

Washing device for automatically brushing and applying cleaning fluid to a soiled implement such as a golf club. The device has a cylindrical rotating brush, cleaning nozzles for directing jets of cleaning fluid axially along the peripheral surface of the rotating brush, and hood means enclosing at least one end of the brush to capture the undeviated portion of the cleaning jet. Portions of the cleaning jet and brush are exposed while the device is in use, permitting the progress of cleaning to be determined without interruption. In a preferred mode of the invention the axis of rotation of the brush is vertical, the jets of water are directed vertically upward, and the brush is driven by a turbine powered by the same water supply that provides cleaning fluid. A self-draining basin formed integrally with the hood can be disposed about the cleaning area. The cleaning jets are preferably taken from the housing of the turbine, and are formed by nozzles comprising holes in the upper portion of the turbine housing.

12 Claims, 4 Drawing Figures

10
14
16
18
20
22
24
28
30
32
34
36
38
40
46
48
50
52
70
72
74
76
78
80
82
86
88

GOLF CLUB CLEANER

TECHNICAL FIELD

The invention is apparatus employing a rotating brush and a supply of cleaning fluid to clean an implement, particularly a golf club.

BACKGROUND OF THE INVENTION

There are many cleaning devices which employ a rotating or moving brush element and a source of water or another cleaning fluid to remove soil from a golf club or other implement. Three examples of such devices are shown in U.S. Pat. No. 3,148,396, issued to Smith on Sept. 15, 1964; U.S. Pat. No. 3,332,099, issued to Reiter on July 25, 1967; and U.S. Pat. No. 3,619,841, issued to Russell et al. on Nov. 16, 1971. Such devices typically require a source of electric power, as they use electric motors to turn the brush elements and often require a pump to draw the cleaning fluid from a bulky tank for delivery to the brushes. Water is used in the cleaning process and a metal club shaft will conduct electricity, so such apparatus creates an inherent electrical shock hazard.

Furthermore, such devices generally do not allow the operator to observe the progress of cleaning, as cleaning must take place within a housing to avoid excessive spray. (Prior practice has been to dribble or spray the cleaning fluid into the interior of the brush, causing the brush to fling the cleaning fluid outwardly.) The operator must clean a club within a housing of the device for awhile, remove the club from the device, examine it for cleanliness, and if necessary repeat the process until the club is clean. Prior devices are thus too bulky and inconvenient to be practice for use by an individual golfer.

Prior club cleaners also lack the necessary adaptations to clean high loft clubs, particularly higher-numbered irons or sand wedges, the working face and shaft of which are much more nearly perpendicular than corresponding parts of lower loft clubs.

Finally, prior automated club cleaners cannot be used with complete safety to the clubs and operator, as they include moving parts but no limitation on the amount of force turning them.

SUMMARY OF THE INVENTION

My improved golf club or implement cleaner includes a rotating brush element, preferably driven by water or another cleaning fluid supplied under pressure from an ordinary tap. Such drive means can be so sized that the device will stall if undue pressure is applied to force the club against the rotating brush, or if a person or object is caught in moving parts of the device. My device applies the cleaning fluid to the brush by directing one or more cleaning jets from the water supply to the brush. Consequently, a cleaning fluid and a rotating brush can be simultaneously applied to the implement being cleaned without the need for a source of electric power.

My improved cleaning apparatus is preferably arranged differently from known golf club cleaners. The cleaning jets are directed axially along the peripheral surface swept by the rotating brush. Portions of the cleaning jets are deviated by contact with the implement being cleaned and the cleaning brush. A hood enclosing one end of the rotating brush intercepts undeviated portions of the cleaning jets. In the preferred embodiment the cleaning jets spray upwardly and the brush is carried on a vertically disposed axial shaft. Little cleaning fluid is flung outward, allowing the working portions of the brush and cleaning jets to be exposed while cleaning takes place. Another advantage of spraying the cleaning jets upwardly is that when they are intercepted by a club they are deflected downwardly or into the brush, reducing the amount and controlling the direction of unwanted spray.

As another preferred feature, the hood surrounding one end of the brush can extend vertically upward from a self-draining basin disposed about the opening that provides access to the rotating brush and cleaning jets. The used cleaning fluid thus can be conveniently drained to a desired location. The hood and self-draining basin can be molded as a single part, thus providing a very economical construction.

BRIEF DESCRIPTION OF PREFERRED EMBODIMENTS

Figure 1:
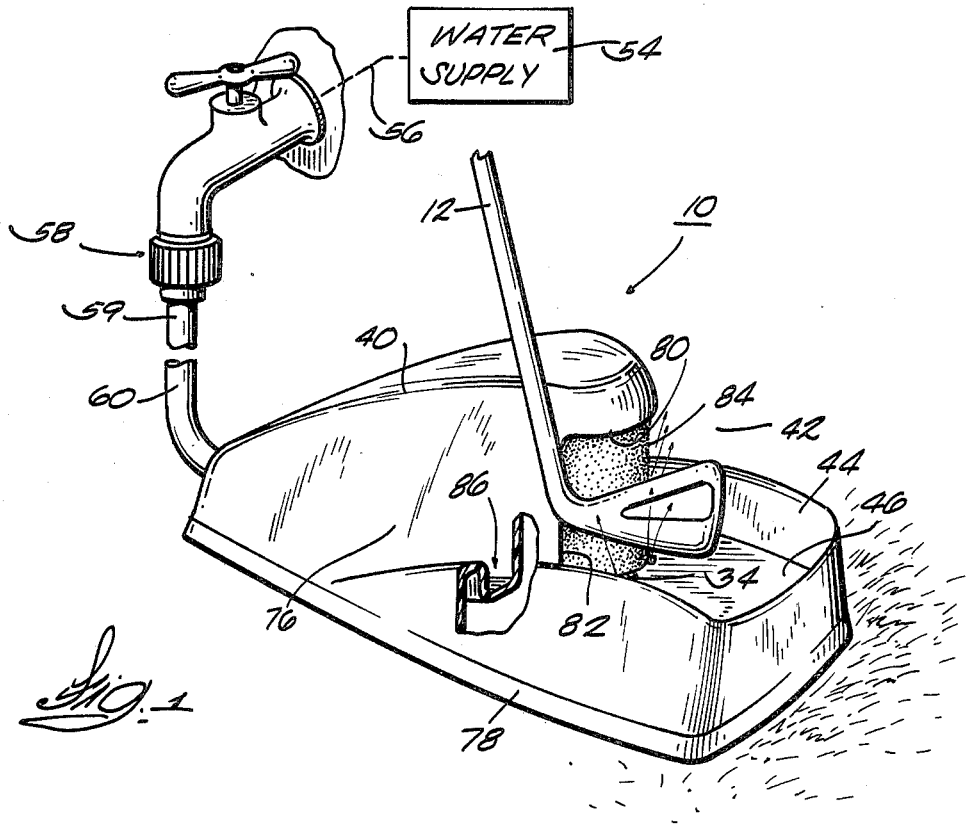
FIG. 1 is a perspective view of the invention, showing the device being addressed from the right by a right-handed golf club.
Figure 3:
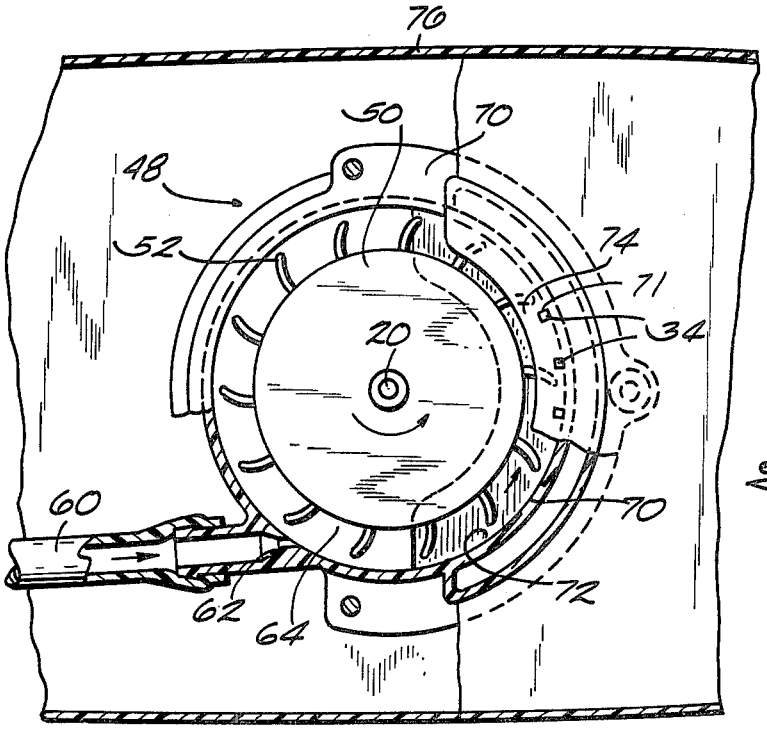
FIG. 3 is a fragmentary top plan view of the invention, with parts broken away or shown in section for further clarity, illustrating the turbine assembly which drives the rotating brush element.
Figures 2, 4:
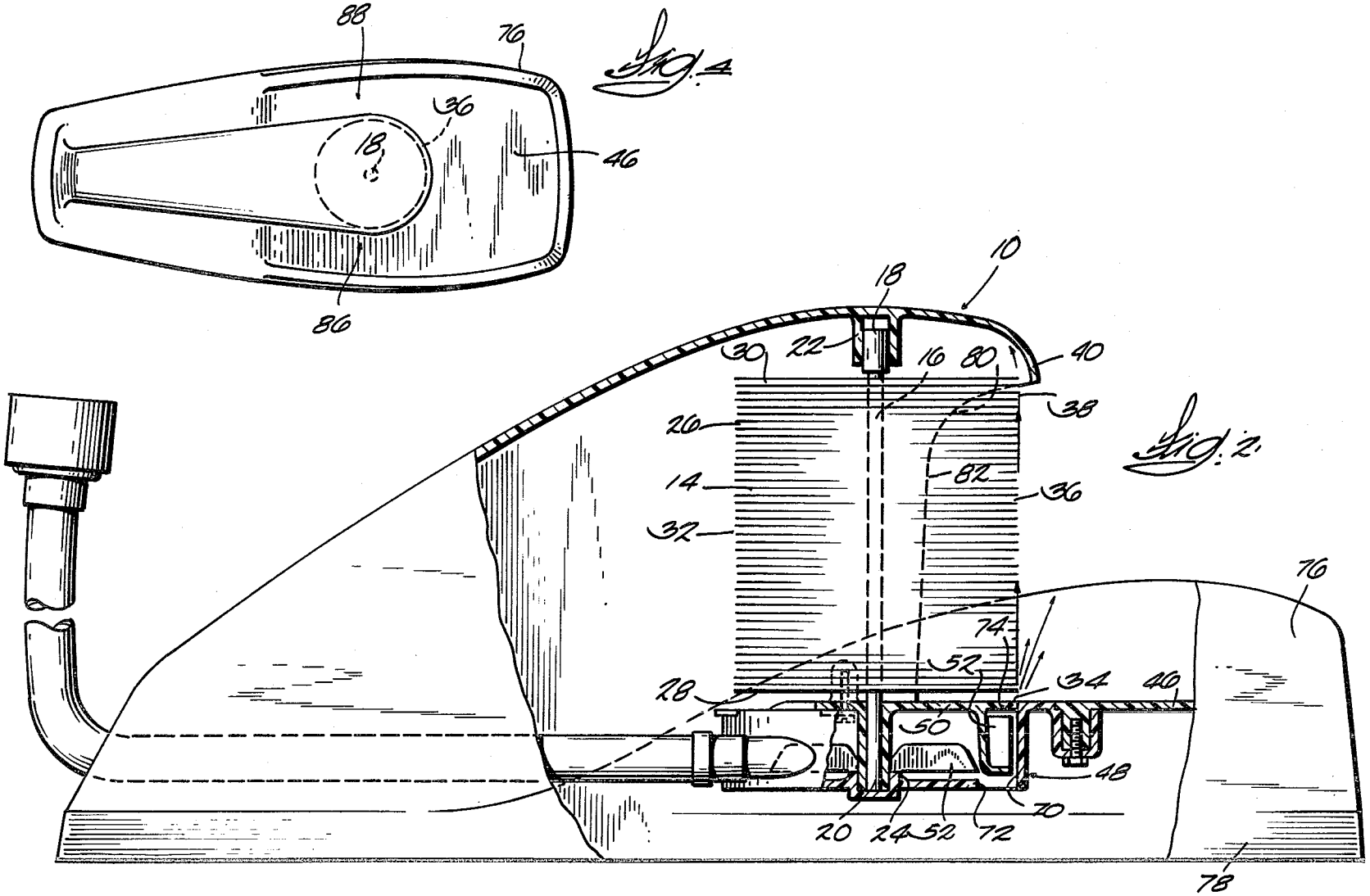
FIG. 2 is a side elevation of the invention, with portions broken away or shown in section to further illustrate certain features.
FIG. 4 is a reduced size top plan view of the invention, further illustrating the self-draining basin feature.

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Referring to the figures, washing device 10 for cleaning a soiled workpiece 12—here, a golf club—includes a generally cylindrical brush 14 having an axial shaft 16, the ends 18 and 20 of which are carried in journals 22, 24. Brush 14 has bristles 26 extending radially from shaft 16. The body of bristles 26 defines first and second ends 28, 30 of brush 14, and the radial extremities of bristles 26 sweep a cylindrical peripheral surface 32 when shaft 16 is rotated. Device 10 further includes cleaning nozzle means such as 34 for directing at least one, here four, cleaning jets 36 axially upward along surface 32 from a point adjacent first end 28 of the brush. The cleaning nozzle means 34 are directed so an undeviated portion 38 of cleaning jet 36 does not wet brush 14 except during cleaning. Another portion of each cleaning jet can contact the brush to keep it wet. Undeviated portion 38 is captured by hood means 40, which encloses at least a part of second end 30 of brush 14. That the cleaning jet is sprayed upward and the undeviated portion 38 is intercepted is very important, as deflected spray resulting from the cleaning operation will mostly be deflected downwardly or into brush 14. (If the jet sprayed downward, spray deflected from the implement would mostly be directed outward or upward.) Brush 14 preferably travels counterclockwise in a device for use on right-handed clubs so the device can be addressed just as a golf ball is addressed by a right-handed golfer (see FIG. 1). When the brush turns counterclockwise, any spray deflected by the brush tends to travel in the direction of spray 42 in FIG. 1, so a large proportion of it is captured by flange 44 of basin 46, and the remaining portion of the spray travels away from the golfer. It will be observed that, unlike prior devices, this arrangement allows at least a portion of brush 14 and cleaning jets 36 to be accessible during cleaning, rather than within a closed chamber. A person using the device can thus observe the progress of cleaning while it takes place, eliminating the need to interrupt the cleaning process while determining whether the club is clean.

While other drive means are possible within the scope of the present invention, the illustrated turbine means generally indicated at 48 is greatly preferred. Turbine means 48 comprises a rotor 50 fixed to end 20 of shaft 16 coaxially with brush 14. Rotor 50 has the usual vanes 52. Rotor 50 is driven by a source of cleaning fluid maintained under pressure—here, a conventional water supply 54 connected via a supply conduit 56 to tap 58. The water from tap 58 enters inlet end 59 of a hose or other conduit 60 coupled to tap 58. A drive nozzle 62, defining the outlet end of hose 60, forms a drive jet 64 directed against vanes 52, thereby turning rotor 50 counterclockwise.

Associated with rotor 50 are fluid directing means 70 defining a channel swept by vanes 52. A fluid outlet 72 in fluid directing means 70 is provided for drainage.

Cleaning jets 36 are provided by diverting a portion of the flow of cleaning fluid through turbine means 48. Cleaning nozzle means 34 are each openings in the upper wall 74 of fluid directing means 70. For convenience the jets are disposed circumferentially, but other arrangements can be employed within the scope of the invention. The direction of drive jet 64 has an upward component and vanes 52 are shaped to deflect some of the drive jet 64 upwardly, thereby directing it to cleaning nozzle means 34. Each nozzle means 34 is here a perforation having a radially disposed downstream edge 71 in relation to turbine 48, and each perforation is preferably square or D-shaped. Such a configuration is better than others because the radially disposed downstream edge apparently shears off some of the circumferential guided flow within turbine 48, directing it upwardly.

In a preferred embodiment of the invention, turbine means 48 is mounted with screws or by other means to the underside of an injection molded or thermoformed plastic shell housing 76, of which hood means 40 and basin 46 are integral parts. Only the portion of upper wall 74 defining cleaning jets 34 is exposed, as best shown in FIG. 1. The turbine-driving fluid exhausted from turbine means 48 is confined by a skirt 78 which effectively surrounds fluid outlet 72 and is meant to rest on a flat surface in use, therefore directing the portion of the cleaning fluid passing from fluid outlet 72 harmlessly to the ground.

The illustrated machine is particularly well adapted for use by a right-handed operator cleaning right-handed clubs. This is illustrated in FIG. 1, as the handle of implement 12 extends to one side of basin 46 while any excess spray 42 is directed to the other side of basin 46. To adapt the device for use on left-handed clubs, the direction of rotation of the brush should be reversed. It will be self-evident that reversing the direction of the brush for a left-handed golfer could be accomplished by rearranging turbine means 48.

As another feature of the illustrated embodiment, hood means 40 surrounds the nonworking portion of brush 14 and includes an opening 80 which has first and second side edges 82 and 84. A portion of surface 32 projects between side edges 82 and 84, therefore improving access to brush 14 and cleaning jet 36.

Another feature of the illustrated invention is that basin 46 is self-draining, as water will follow the sloped paths 86 and 88 along the respective sides of hood means 40.

Still another feature of the illustrated invention is that it is well-adapted to clean every type of club commonly carried by golfers. A high loft club, such as a sand wedge, can be cleaned by orienting it so its working face is substantially vertical and tangent to brush 14. The handle of the club will not interfere, as it can be received in path 86 (for a right-handed club) and will lie to one side of hood means 40 and within flange 44 of housing 76. Low loft clubs such as 12 present no problem, as for them the club shaft will be more nearly vertical when the working face is positioned for cleaning. Woods also present no problem, as basin 46 is wide enough to easily accomodate them.

I claim:

1. A washing device for delivering a cleaning fluid and applying mechanical cleaning action to a soiled workpiece, said device comprising:

A. a generally cylindrical brush carried on an axial shaft and having first and second ends;

B. drive means for rotating said shaft, thereby causing said brush to sweep a cylindrical peripheral surface;

C. cleaning nozzle means for directing at least one cleaning jet of said cleaning fluid axially along said peripheral surface toward said second end of said brush; and D. hood means enclosing at least part of said second end to intercept an undeviated portion of said at least one cleaning jet;

wherein portions of said cylindrical surface and said at least one cleaning jet are exposed, permitting one to apply said workpiece to said brush and cleaning jet while simultaneously observing the progress of cleaning.

2. The device of claim 1,:

A. wherein said drive means comprises turbine means including a rotor operatively associated with said brush; and further comprising B. a conduit having an inlet end and an outlet end, said inlet end including means for being connected to a source of a cleaning fluid maintained under pressure, said outlet end including drive nozzle means to direct a drive jet of said cleaning fluid at said turbine means for driving said rotor, thereby rotating said brush.

3. The device of claim 2, further comprising fluid directing means associated with said rotor and a fluid outlet defined by said fluid directing means at a point circumferentially spaced from said conduit outlet end in the direction of driven travel of said rotor, said cleaning nozzle means being operatively associated with said fluid directing means for diverting a pressurized flow of said cleaning fluid to form said at least one cleaning jet:

4. The device of claim 3, wherein said cleaning nozzle means comprises at least one opening in said fluid directing means.

5. The device of claim 4, wherein each said cleaning nozzle opening has a radially disposed downstream edge with respect to said turbine.

6. The device of claim 3, further comprising a skirt surrounding said fluid outlet to downwardly direct the portion of said cleaning fluid passing from said fluid outlet.

7. The device of claim 4, wherein said axis is disposed generally vertically and said at least one cleaning jet is directed generally upwardly.

8. The device of claim 7, wherein said brush rotates counterclockwise and said opening is to the right of said axis as viewed from the perspective of a person addressing said device from the right with said soiled workpiece.

9. The device of claim 1, wherein said hood means encloses a substantial portion of said cylindrical surface and includes an opening for exposing portions of said cylindrical peripheral surface and said at least one cleaning jet.

10. The device of claim 9, wherein said opening is defined by first and second side edges and a portion of said cylindrical surface projects between said side edges for improving access to said brush and said at least one cleaning jet.

11. The device of claim 9, wherein said hood means extends vertically upward from a self-draining basin disposed about said opening.

12. The device of claim 11, wherein said hood means and basin are integral portions of a single molded part.

* * * * *